United States Patent [19]

Labombarde et al.

[11] 4,279,611

[45] Jul. 21, 1981

[54] APPARATUS AND METHOD FOR FOLDING BLANKS WITH AN UNUSUALLY ELONGATED WALL

[76] Inventors: Raymond A. Labombarde, D. W. Hwy. South Box 787, Nashua, N.H. 03061; Robert A. Tremblay, 167 Derry Rd., Hudson, N.H. 03051

[21] Appl. No.: 109,980

[22] Filed: Jan. 7, 1980

[51] Int. Cl.[3] ..... B31B 1/36; B31B 1/96

[52] U.S. Cl. ..... 493/418; 493/419; 493/438; 493/177

[58] Field of Search ..... 93/49 M, 49 R, 45, 84 FF, 93/84 R, 62, 61 R, 63 M, 63 R, 13; 270/68 R, 69, 45; 271/151, 202

[56] References Cited

U.S. PATENT DOCUMENTS

| | | | |
|---|---|---|---|
| 2,983,201 | 5/1961 | Winkler et al. | 93/62 |
| 3,079,144 | 2/1963 | Frei | 93/13 X |
| 3,110,232 | 11/1963 | Frei | 93/84 FF |
| 3,377,927 | 4/1968 | Pröpper | 93/49 R |
| 3,773,319 | 11/1973 | Hottendorf et al. | 271/151 |
| 3,907,272 | 9/1975 | Joa | 271/202 X |

FOREIGN PATENT DOCUMENTS

| | | | |
|---|---|---|---|
| 1278209 | 9/1968 | Fed. Rep. of Germany | 93/49 R |

*Primary Examiner*—James F. Coan

*Attorney, Agent, or Firm*—Pearson & Pearson

[57] ABSTRACT

A box blank of the type having two side walls and a front wall of normal length but a combined bottom and rear wall of unusual length is folded and glued on a box folding and gluing machine by advancing the blanks along a horizontal path, long wall first, and overlapped in shingled formation. The first long wall in the formation encounters an air blast, or hooked finger, which unfolds the leading edge to encounter a ramp-like guide which bends it back to fold on its fold line, while also back folding the next successive long wall. All successive blanks are so back folded in "domino" fashion.

11 Claims, 7 Drawing Figures

APPARATUS AND METHOD FOR FOLDING BLANKS WITH AN UNUSUALLY ELONGATED WALL

BACKGROUND OF THE INVENTION

It has long been known in the paper trade to advance a plurality of sheets, or flat tubular cartons, along a path at a predetermined normal speed of conveyance and with a normal spacing, for treatment in successive zones along the path. After passing through the treatment zones it has been known to slow down the blanks, usually by upper and lower carrier belts to cause the sheets, or cartons, to overlap each other in shingled formation for ease in loading, discharge and packaging.

In U.S. Pat. No. 2,819,079 to Beaulieu of Jan. 7, 1958, a plurality of cut sheets are speeded up by sets of lower carrier tapes to shingle, and are then further slowed by subsequent carrier tapes to shingle further before delivery to a layboy.

The following patents are also exemplary of conveyors which cause sheets, or flat cartons to overlap and shingle, usually by merely slowing the advance to cause a following sheet to overlap a preceding sheet.

U.S. Pat. No. 3,096,^78 Jendrusch—July 9, 1963
U.S. Pat. No. 3,373,606 Crampton—Mar. 19, 1968
U.S. Pat. No. 3,911,800 Feldkamper—Oct. 14, 1975
U.S. Pat. No. 3,942,786 Lauren—Mar. 9, 1976

SUMMARY OF THE INVENTION

In this invention, the problem to be solved is not merely the overlapping of a plurality of flat sheets which have been advancing individually and successively along a path through a machine, so that the shingled sheets can be lifted as a unit from the delivery zone into a box.

Shingling in this invention is used in the treatment zones along the paper line for the purpose of handling elongated blanks which take too long in passing through the machine.

The particular blank used in the invention, when erected, forms a cup and has a front wall and two hingedly connected side walls of normal dimensions. However, the rear wall is longer than the front wall and is hingedly connected to the bottom wall, with the combined rear wall and bottom wall forming an unusually long element which is not only difficult to fold but occupies an unusually long portion of the paper line when the blank is flat.

At normal speeds of conveyance, and at normal spacing of blanks, a conventional folder gluer such as the "Speed King" manufactured by the International Paper Box Machine Company of Nashua, N.H. would run such blanks at about 20,000 to 40,000 per hour, due to the length of the blank.

The apparatus and method of this invention enables the machine to fold such blanks at a rate up to 125,000 per hour with the blanks travelling at 1040 feet per minute through the machine. This is accomplished by feeding the blanks along the paper line of the machine in overlapped shingled formation, then holding down the side walls of the advancing shingled blanks while lifting the elongated rear wall of the first blank and back folding it over the body of its blank thereby backfolding successive rear walls over the bodies of the successive blanks in "domino" fashion. The backfolded, shingled blanks are then speeded up to separate them to advance individually and successively, and unshingled, through the folding and gluing zones of the machine.

Thus the machine is enabled to operate at high speed as though the blanks were short and closely spaced, because they have been advanced while shingled and backfolded into a shorter length while shingled, and then separated to normal spacing.

BRIEF DESCRIPTION OF THE DRAWING

FIG. 5 showing the blank prior to folding, FIG. 4 showing the elongated wall backfolded over the body of the blank and FIG. 3 showing the side flaps in-folded and glued to form the cup.

DESCRIPTION OF THE PREFERRED EMBODIMENT

Figure 5:
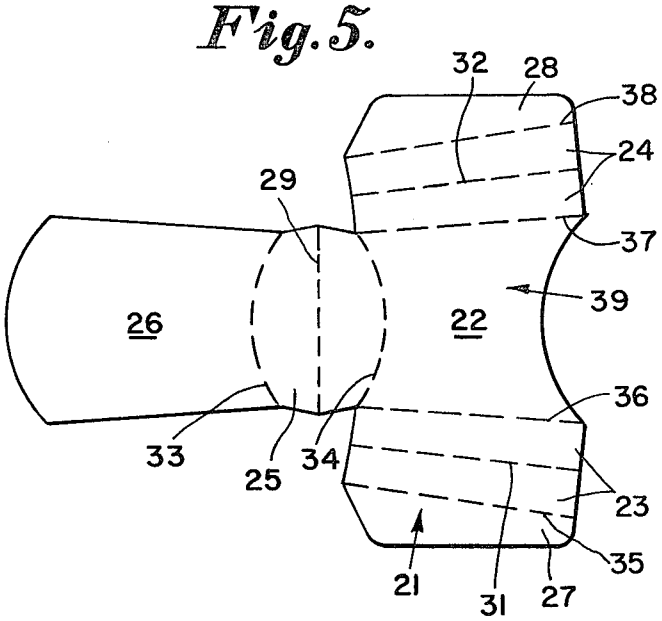
FIGS. 3, 4 and 5 are enlarged plan views showing a typical blank used in the apparatus and method of the invention.
Figure 4:
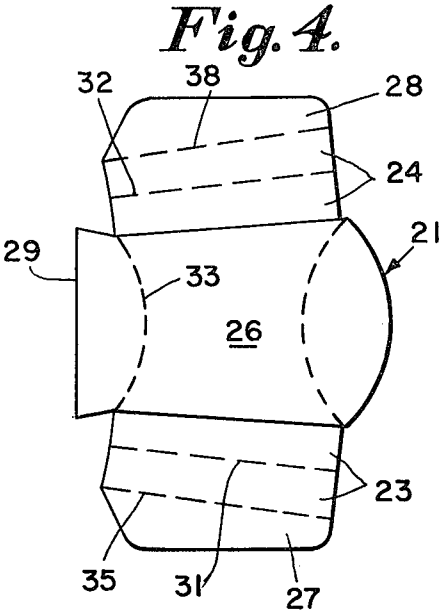
Figure 3:
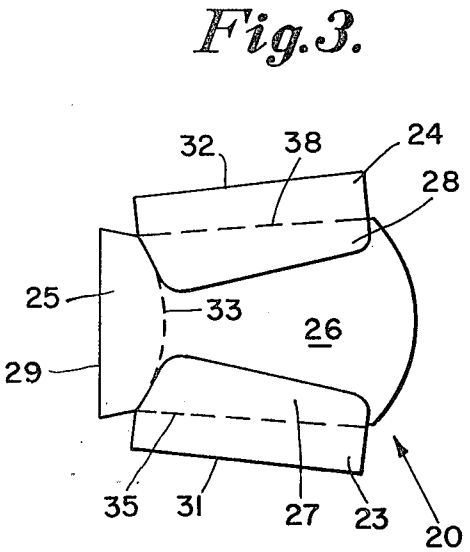

As shown in FIGS. 3–5, the cup 20 is of the flatfolded type used to hold foodstuffs such as french fried potatoes, fried clams or the like. The blank 21, from which it is formed, includes the front wall 22, opposite side walls 23 and 24, bottom wall 25, rear wall 26, and opposite glue tabs 27 and 28. The bottom wall 25 has a central fold line 29 on each side wall 23 or 24 has a central fold line 31 or 32 to permit the glued cup 20 to be shipped and stored in flat condition as shown in FIG. 3. All of the walls are hingedly connected along precreased fold lines 33, 34, 35, 36, 37 and 38, in a manner well known in the art.

As stated above, the unusual configuration of the blanks 21, in having a combined rear wall 26 and bottom wall 25 or substantially greater length than the length of the main body 39, slows production appreciably because of the longitudinal area occupied on the horizontal path, or paper line, 41 of the box folding and gluing machine 42. It will be seen that the shorter the blank, the more blanks can be folded individually and successively as they advance along the path 41.

Figure 1:
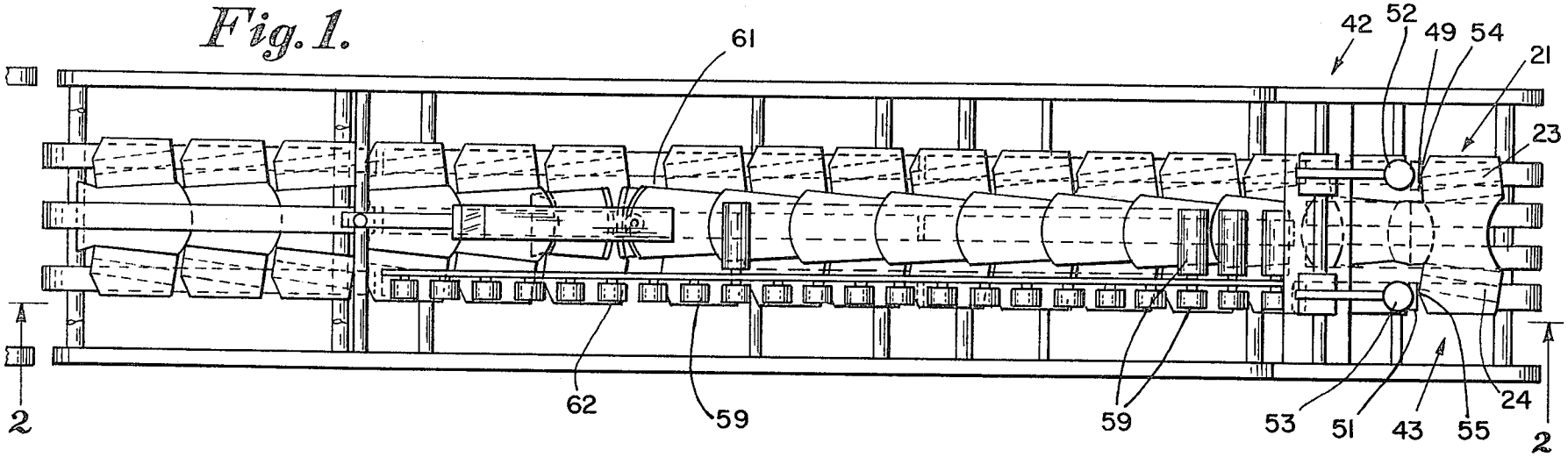
FIG. 1 is a diagramatic plan view of folding apparatus constructed in accordance with the invention.
Figure 2:
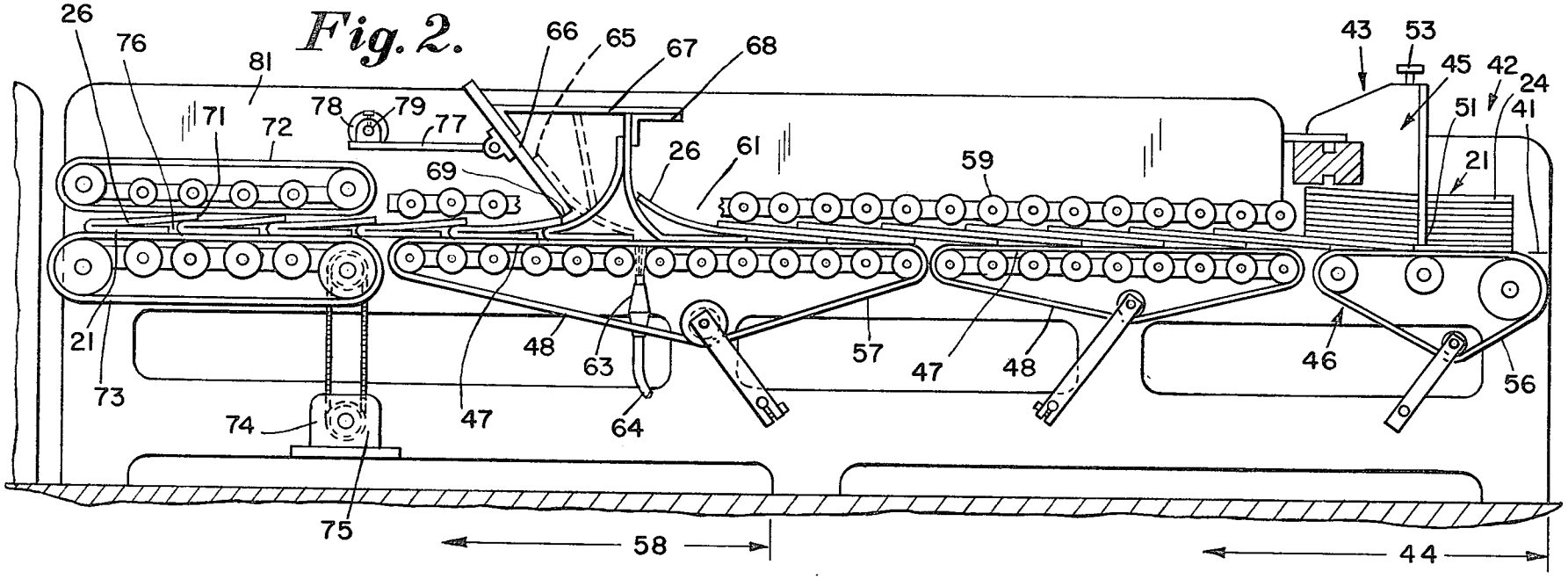
FIG. 2 is a diagramatic side elevation of the apparatus shown in FIG. 1.

In FIGS. 1 and 2, a typical box folding and gluing machine 42 is diagramatically illustrated, the machine being a "Speed King", as manufactured by The International Paper Box Machine Co., of Nashua, N.H., with the apparatus of the invention installed thereon.

Machine 42 includes box blank feed means 43, in a blank feed zone 44, comprising a magazine 45 for a plurality of box blanks 21 stacked therein and blank feed mechanism 46, of known type, for feeding blanks individually and successively, in untimed sequence, onto the horizontal path 41 defined by the upper stretches 47 of blank carrier belts 48.

The magazine 45 includes gateways 49 and 51, adjustable by knobs such as at 52 and 53 to retain the leading edges 54 and 55 of the side walls 23 and 24 of the blanks 21, while passing only one blank at a time from the magazine onto the paper line 41. It should be noted that the elongated combined rear walls 26 and bottom walls 25 of each blank extend in front of the gateways 49 and 51 so that the magazine 45 operates to feed successive, individual blanks as though the blanks were short and as though they were only as long as the length of the side walls 23 and 24.

Thus, unlike conventional magazine feeds wherein the blanks are fed one at a time through a gateway with a space between successive, flatwise blanks as they travel along the paper line through the folding zones, in this invention the blanks 21 are fed onto the paper line from the magazine in overlapping, shingled formation.

The magazine feed belts 56 of feed mechanism 46, the lower carrier belts 48, and the lower carrier belts 57 in the backfolding zone 58 are all synchronized to advance the shingled blanks 21 along the paper line 41 and through zone 58 at conventional, predetermined, speed so that no time is lost due to the unusual length of the forwardly-extending, elongated, combined rear wall 26 and bottom wall 25. Suitable hold down rolls 59 are provided in backfolding zone 58.

Upon start up of the machine 42, the flat, elongated, blanks 21 are advanced along the horizontal path, defined by paper line 41, individually and successively in overlapping, shingled formation at normal machine speed of 120,000 blanks per hour. The hold down rolls 59, grip the advancing, shingled blanks along the side walls 24, until the shingled blanks reach the back fold zone 58, in which zone there is a gap 61 to permit backfold of the rear wall 26 with half of the bottom wall 25 on the central fold line 29. Control and advance of the shingled blanks is maintained by the outer portions 62 of the hold down rolls 59, in cooperation with the lower carrier belts 57.

Figure 6:
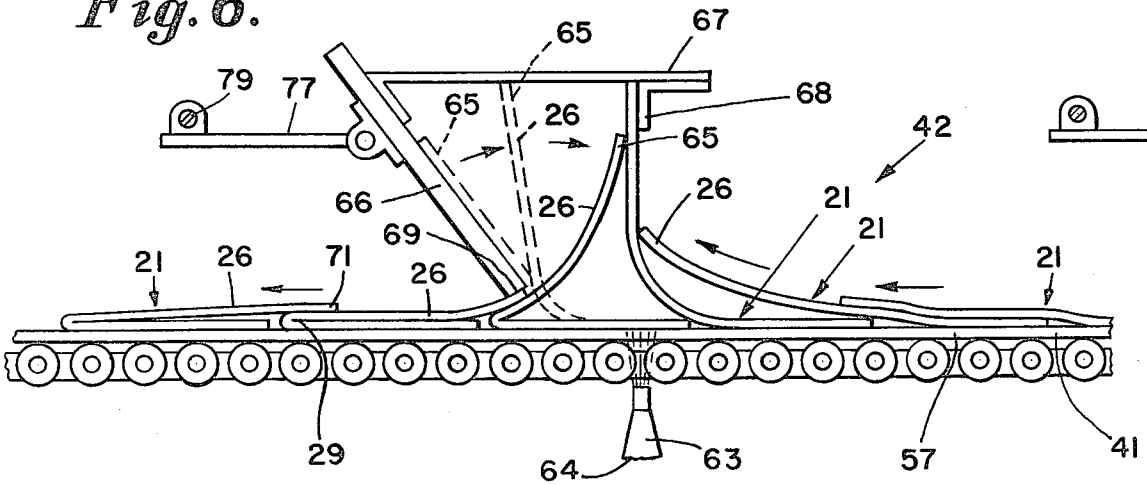
FIG. 6 is an enlarged, diagramatic, side elevation showing the backfolding of each elongated wall of individual and successive shingled blanks by the backfolding of the elongated walls of preceding shingled blanks

As best shown in FIG. 2 and FIG. 6, when the leading, flat rear wall 26, of the leading, flat shingled blank 21 is advanced along the paper line 41 into the back fold zone 58, lift means is encountered pereferably in the form of an upwardly directed air blast from a nozzle 63, fed by a conduit 64 from a source of air under pressure, not shown, such as mill air, which lifts the panel, or wall 26 up away from the plane of the paper line 41 as shown. The leading edge 65, of this first, or leading blank, engages and is slidably guided upwardly on an inclined guide, or ramp, 66, as shown in dotted lines, to engage the cover element 67 and then the stop element 68 to be backfolded upon itself and continue advance in down folded condition under the lower edge 69 of the ramp.

The first backfolded panel, or rear wall 26 upon rising from the level of paper line 41, lifts the next successive rear wall 26 shingled thereon so that it too, and each successive rear wall 26 is backfolded on its fold line 29 with no need for the air blast from nozzle 63. Thus, each successive and individual elongated flat blank in the advancing shingled formation is backfolded in zone 58 to occupy approximately the same space on the paper line, but to do so in backfolded configuration rather than in shingled elongated configuration.

Upon advancing along the paper line under the lower edge 69 of guide 66 with the trailing portion 71 of the backfolded rear wall of each leading blank overlying the leading fold line portion 29 of the next successive blank, the train of blanks enter the nip between upper carrier belts 72 and lower carrier belts 73. Lower carrier belts 73 are driven at a slightly higher speed than the speed of the blanks emerging from backfold zone 58, by the variable speed drive unit 74 and electric motor 75. Thus, the backfolded blanks are gradually moved away from each other until there is a space 76 between successive blanks.

The spaced backfolded blanks are then glued in a gluing zone by glue wheels all of well known type, the side flaps are infolded also by known mechanism and the completed cups are then stacked on a stacking apron also in a known manner.

The inclined guide, or ramp, 66 is preferably of Nylon and is adjustable on an arm 77 which in turn is adjustable by a clamp 78 on a rod 79 supported on the machine frame piece 81. The stop element 68 may also be adjustably slidable on cover element 67. The leading edge of the leading flap of the leading blank, advancing at the head of the shingled formation, can be lifted upwardly to upfold the flap on its foldline to a level above the level of the paper line by a hooked finger, pivotally mounted above the paper line to direct the leading edge onto the guide, or ramp, 66 whereupon the backfolding of all succeeding shingled blanks is accomplished in "domino" fashion, as described above.

Figure 7:
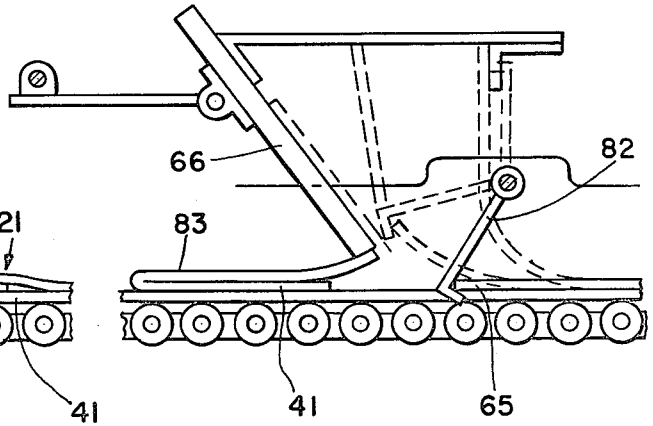
FIG. 7 is a view similar to FIG. 6 of another embodiment of the invention.

Such a hooked finger 82 is shown in FIG. 7, cooperating with the inclined guide, or ramp, 66, to lift the leading edge 65 of the leading flat rear wall 26 of the leading blank 21, above the level of the paper line 41 for commencing the domino type back fold of all succeeding blanks as shown in dotted lines at 83.

We claim:

1. In a paper box folding and gluing machine:

apparatus for folding elongated paper box blanks of the type having a front wall with a pair of side walls hingedly connected thereto, all of predetermined length, a bottom wall hingedly connected to said front wall, and an elongated rear wall hingedly connected to said bottom wall, said bottom wall and rear wall together being of predetermined length greater than the length of said front and side walls said apparatus comprising;

box blank feed means including a magazine for holding a stack of said blanks, a pair of blank feed gateways each for retaining the leading edges of the side walls of the blanks in said magazine while passing each individual and successive lowermost blank in said stack and powered feed mechanism operable to advance each said successive lower most blank through said gateways onto blank carrier means in shingled formation with the elongated rear wall and bottom wall of each blank overlying a portion of the elongated rear wall and bottom wall of the preceding blank;

box blank carrier means for advancing said shingled blanks received from said box blank feed means along a path through a backfolding zone into a speed up zone;

backfolding means, in said backfolding zone, including lift means for upfolding the rear wall of the leading blank of said shingled formation of blanks to a level above the level of said path and backfolding apparatus including an inclined guide mounted above said path to receive said upfolded rear wall and cause it to back fold over the front wall of its blank while advancing thereunder;

each said backfolded rear wall lifting and backfolding the rear walls of the next successive shingled blanks so that all of said shingled blanks are backfolded in domino fashion in said backfolding zone;

blank speed-up means in said speed-up zone for receiving the backfolded, still shingled blanks advancing under said backfolding guide, and increasing the speed of each successive individual blank slightly to create a space between successive blanks to permit overfolding and gluing of the side flaps thereof in succeeding zones of said machine.

2. Apparatus as specified in claim 1 wherein:

said lift means is an air blast nozzle, mounted below the level of said path, and air pressure control means connected to said nozzle.

3. Apparatus as specified in claim 1 wherein:

the inclined guide of said backfolding apparatus is fixed on the free end of an arm and the other end of the arm is adjustably clamped on a rod affixed to the frame of said machine;

4. Apparatus as specified in claim 1 wherein:

said backfolding apparatus includes said inclined guide and a cover angularly disposed to the top of the guide to extend substantially horizontally.

5. Apparatus as specified in claim 1 wherein:

said backfolding apparatus includes said inclined guide, a cover extending substantially horizontally from the top of said guide in a rearward direction and a stop extending substantially vertically and downwardly from the rear of said cover.

6. Apparatus as specified in claim 1 wherein:

said guide is of Nylon and extends in a flat inclined plane.

7. Apparatus for folding box blanks of the type having a front wall and a pair of hingedly connected side walls of relatively short length but having a bottom wall and rear wall hingedly connected to the front wall and projecting substantially therefrom so that the flat blank occupies the space on the paper line of a box folding machine of a relatively long blank, said apparatus comprising:

carrier means on said apparatus, for advancing blanks along a horizontal path from a feed zone, through a backfolding zone into a speed up zone;

bottom feed blank magazine means in said feed zone, advancing said blanks individually and successively onto said carrier means in shingled formation with the rear wall of each blank in the lead and overlying the lower portion of the rear wall of the preceding blank;

backfolding means including lift means below said path and an inclined backfolding guide mounted above said path, in said backfolding zone; and lift means unfolding the leading rear wall of the leading blank in said shingled formation up above the level of said path into said guide and said guide backfolding said rear wall, and causing that rear wall to backfold the rear wall of the next successive blank in "domino" fashion, as said blanks are advanced through said zone and under the lower edge of said guide;

and speed-up means in said speed-up zone for increasing the rate of advance of each successive, backfolded, slightly shingled blank received therein to create a space therebetween to enable infolding and gluing of the side walls thereof.

8. Apparatus as specified in claim 7 plus:

means for slowing down the advance of said shingled blanks enough to have the leading edge of the leading flap of each blank overlap the fold line of the previously fed blank to increase the shingling thereof sufficiently to permit a domino fold.

9. The method of folding flat box blanks of the type having front and side walls of relatively short length, but having a combined bottom wall and rear wall projecting from the center of the bottom of the front wall to create a blank of relatively long length, occupying substantial space on the paper line of a folding machine and, therefore, slowing production, said method comprising the steps of;

feeding said blanks onto the paper line of said machine in shingled formation with the rear walls of each blank overlying a portion of the rear wall of the preceding blank;

advancing said shingled blanks along said paper line and while so advancing, backfolding each successive individual rear wall in a backfolding zone, the backfolding of a preceding rear wall causing the backfolding of the overlying rear walls of succeeding shingled blanks in domino fashion; and then speeding up the advance of said backfolded, shingled blanks individually in a speed up zone along said path to create a space between successive blanks.

10. A method as specified in claim 9 wherein:

said backfolding step includes the step of upfolding the leading rear wall of the leading blank to a level above the level of said paper line.

11. A method as specified in claim 10 wherein:

said upfolding step is accomplished by a stream of pressurized air.

* * * * *

UNITED STATES PATENT OFFICE

CERTIFICATE OF CORRECTION

Patent No. 4,279,611 Dated July 21, 1981

Inventor(s) RAYMOND A. LABOMBARDE, et al

It is certified that error appears in the above-identified patent and that said Letters Patent are hereby corrected as shown below:

Claim 7, line 47 "unfolding" should be "upfolding"

Claim 9, line 28 "walls" should be "wall."

Signed and Sealed this

*Twenty-second* Day of *September 1981*

[SEAL]

*Attest:*

GERALD J. MOSSINGHOFF

*Attesting Officer*

*Commissioner of Patents and Trademarks*